US011587501B2

(12) United States Patent
Han et al.

(10) Patent No.: US 11,587,501 B2
(45) Date of Patent: Feb. 21, 2023

(54) DISPLAY APPARATUSES, PIXEL CIRCUITS AND METHODS OF DRIVING PIXEL CIRCUIT

(71) Applicant: BOE Technology Group Co., Ltd., Beijing (CN)

(72) Inventors: Seungwoo Han, Beijing (CN); Haoliang Zheng, Beijing (CN); Dongni Liu, Beijing (CN); Li Xiao, Beijing (CN); Liang Chen, Beijing (CN); Hao Chen, Beijing (CN); Jiao Zhao, Beijing (CN); Jin Yang, Beijing (CN); Minghua Xuan, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/509,899

(22) Filed: Oct. 25, 2021

(65) Prior Publication Data

US 2022/0215793 A1 Jul. 7, 2022

(30) Foreign Application Priority Data

Jan. 4, 2021 (CN) ..... 202110004616.6

(51) Int. Cl.
*G09G 3/32* (2016.01)

(52) U.S. Cl.
CPC ..... *G09G 3/32* (2013.01); *G09G 2300/0842* (2013.01); *G09G 2310/0275* (2013.01); *G09G 2310/061* (2013.01); *G09G 2310/08* (2013.01)

(58) Field of Classification Search
CPC ..... G09G 3/32–3291; G09G 2300/0421–043; G09G 2300/0809;
(Continued)

(56) References Cited

U.S. PATENT DOCUMENTS

2015/0171156 A1 6/2015 Miyake
2015/0187276 A1* 7/2015 Shim ..... G09G 3/3291 345/77
(Continued)

FOREIGN PATENT DOCUMENTS

CN 107767814 A 3/2018
CN 108711398 A 10/2018
(Continued)

OTHER PUBLICATIONS

CN2021100046166 first office action.

*Primary Examiner* — Nathan Danielsen
(74) *Attorney, Agent, or Firm* — IPro, PLLC

(57) ABSTRACT

The present disclosure provides a display apparatus, a pixel circuit and a method of driving a pixel circuit. In one or more embodiments, the pixel circuit includes a driving transistor, a data signal module and a bias signal module. A first electrode of the driving transistor is connected with a first power signal terminal, a second electrode of the driving transistor is connected with a first terminal of a light emitting element, and the driving transistor includes a first control electrode and a second control electrode. The data signal module is connected with the driving transistor, a data writing signal terminal and a data signal terminal. The bias signal module is connected with the driving transistor, a bias writing signal terminal and a bias signal terminal, and is configured to adjust a threshold voltage of the driving transistor under control of the bias writing signal terminal and the bias signal terminal.

17 Claims, 5 Drawing Sheets

(58) Field of Classification Search
CPC .... G09G 2300/0819; G09G 2300/0833–0842; G09G 2300/0852; G09G 2300/0861; G09G 2300/0866; G09G 2310/0243; G09G 2310/0275; G09G 2310/0289; G09G 2310/061; G09G 2310/08; G09G 2320/0233; G09G 2320/0242; G09G 2320/04–045; G09G 2320/0693; G09G 2380/02
See application file for complete search history.

(56) References Cited

U.S. PATENT DOCUMENTS

| | | | |
|---|---|---|---|
| 2016/0042694 | A1 | 2/2016 | Lim et al. |
| 2019/0164476 | A1 | 5/2019 | Feng et al. |
| 2019/0362674 | A1 | 11/2019 | Xu |
| 2020/0005708 | A1 | 1/2020 | Hwang et al. |
| 2021/0272521 | A1* | 9/2021 | Yoon ..... H01L 27/3258 |
| 2021/0343238 | A1* | 11/2021 | Okabe ..... G09G 3/3275 |
| 2022/0122522 | A1 | 4/2022 | Li et al. |

FOREIGN PATENT DOCUMENTS

| | | | |
|---|---|---|---|
| CN | 110021265 | A | 7/2019 |
| CN | 110660829 | A | 1/2020 |
| CN | 111179850 | A | 5/2020 |
| CN | 112150967 | A | 12/2020 |
| WO | 2020066024 | A1 | 4/2020 |

* cited by examiner

DISPLAY APPARATUSES, PIXEL CIRCUITS AND METHODS OF DRIVING PIXEL CIRCUIT

CROSS REFERENCE TO RELATED APPLICATIONS

This application claims priority to Chinese Patent Application No. 202110004616.6 entitled "DISPLAY APPARATUSES, PIXEL CIRCUITS AND METHODS OF DRIVING PIXEL CIRCUIT" filed on Jan. 4, 2021, the entire content of which is incorporated herein by reference.

TECHNICAL FIELD

The present disclosure relates to the field of display technology, and in particular, to display apparatuses, pixel circuits and methods of driving pixel circuit.

BACKGROUND

An electroluminescent display is a new generation of display products following a liquid crystal display. Due to its better color saturation, fast response speed, foldability, lightness and thinness and other properties, the electroluminescent display is gradually becoming a mainstream and leading product in the field of display technology.

The electroluminescent display includes light emitting elements and pixel circuits connected with the light emitting elements. Each of the pixel circuits includes a driving transistor for outputting a driving current to the light emitting element. Since a value of the driving current is related to a threshold voltage of the driving transistor, when the threshold voltage of the driving transistor is biased positively or negatively, the driving current output to the light emitting element will be abnormal, which reduces the display effect.

SUMMARY

According to one aspect of the present disclosure, there is provided a pixel circuit, including: a driving transistor, wherein a first electrode of the driving transistor is connected with a first power signal terminal, a second electrode of the driving transistor is connected with a first terminal of a light emitting element, and the driving transistor includes a first control electrode and a second control electrode; a data signal module, connected with the driving transistor, a data writing signal terminal and a data signal terminal; a bias signal module, connected with the driving transistor, a bias writing signal terminal and a bias signal terminal, and configured to adjust a threshold voltage of the driving transistor under control of the bias writing signal terminal and the bias signal terminal.

In an embodiment, the bias signal module includes a bias writing transistor, wherein a control electrode of the bias writing transistor is connected with the bias writing signal terminal, a first electrode of the bias writing transistor is connected with the bias signal terminal, and a second electrode of the bias writing transistor is connected with the second control electrode of the driving transistor.

In an embodiment, the bias signal module further includes a first energy storage element, wherein a first terminal of the first energy storage element is connected with the first power signal terminal, and a second terminal of the first energy storage element is connected with the second control electrode of the driving transistor.

In an embodiment, the pixel circuit further includes a first reset module, connected with the second control electrode of the driving transistor and a first reset signal terminal, and configured to transmit a first initialization signal to the second control electrode of the driving transistor under control of the first reset signal terminal.

In an embodiment, the first reset module includes a first reset transistor, wherein a control electrode of the first reset transistor is connected with the first reset signal terminal, a first electrode of the first reset transistor is connected with a first initialization signal terminal, and a second electrode of the first reset transistor is connected with the second control electrode of the driving transistor.

In an embodiment, the data signal module includes: a data writing transistor, wherein a control electrode of the data writing transistor is connected with the data writing signal terminal, a first electrode of the data writing transistor is connected with the data signal terminal, and a second electrode of the data writing transistor is connected with the first electrode of the driving transistor; a compensation transistor, wherein a control electrode of the compensation transistor is connected with the data writing signal terminal, a first electrode of the compensation transistor is connected with the second electrode of the driving transistor, and a second electrode of the compensation transistor is connected with the first control electrode of the driving transistor; and a second energy storage element, wherein a first terminal of the second energy storage element is connected with the first power signal terminal, and a second terminal of the second energy storage element is connected with the first control electrode of the driving transistor.

In an embodiment, the pixel circuit further includes a second reset module, connected with the first control electrode of the driving transistor and a second reset signal terminal, and configured to transmit a second initialization signal to the first control electrode of the driving transistor under control of the second reset signal terminal.

In an embodiment, the second reset module includes a second reset transistor, wherein a control electrode of the second reset transistor is connected with the second reset signal terminal, a first electrode of the second reset transistor is connected with a second initialization signal terminal, and a second electrode of the second reset transistor is connected with the first control electrode of the driving transistor.

In an embodiment, the pixel circuit further includes a third reset module, connected with the first terminal of the light emitting element and a third reset signal terminal, and configured to transmit a third initialization signal to the first terminal of the light emitting element under control of the third reset signal terminal.

In an embodiment, the pixel circuit further includes a light emitting control module, connected with a light emitting control signal terminal, the second electrode of the driving transistor and the first terminal of the light emitting element, and configured to communicate/electrically connect the second electrode of the driving transistor with the first terminal of the light emitting element under control of the light emitting control signal terminal.

In an embodiment, the light emitting control module includes a first light emitting control transistor, wherein a control electrode of the first light emitting control transistor is connected with the light emitting control signal terminal, a first electrode of the first light emitting control transistor is connected with the second electrode of the driving transistor, and a second electrode of the first light emitting control transistor is connected with the first terminal of the light emitting element.

In an embodiment, the light emitting control module further includes a second light emitting control transistor, wherein a control electrode of the second light emitting control transistor is connected with the light emitting control signal terminal, a first electrode of the second light emitting control transistor is connected with the first power signal terminal, and a second electrode of the second light emitting control transistor is connected with the first electrode of the driving transistor.

In an embodiment, the driving transistor is a P-type transistor, the threshold voltage of the driving transistor increases when a potential of a bias signal provided by the bias signal terminal is less than 0, and the threshold voltage of the driving transistor decreases when the potential of the bias signal is greater than 0.

In an embodiment, the driving transistor is an N-type transistor, the threshold voltage of the driving transistor decreases when a potential of a bias signal provided by the bias signal terminal is less than 0, and the threshold voltage of the driving transistor increases when the potential of the bias signal is greater than 0.

According to one aspect of the present disclosure, there is provided a method of driving a pixel circuit, applied to driving the above-mentioned pixel circuits, and the driving method including: the data signal module receives a data writing signal provided by the data writing signal terminal, and transmits a data signal provided by the data signal terminal to the driving transistor; and the bias signal module adjusts the threshold voltage of the driving transistor under control of the bias writing signal terminal and the bias signal terminal.

In an embodiment, a bias signal provided by the bias signal terminal causes a value of the threshold voltage of the driving transistor to exceed or be lower than a potential difference between the first control electrode of the driving transistor and the second electrode of the driving transistor.

According to one aspect of the present disclosure, there is provided a display apparatus, including: the above-mentioned pixel circuits; the light emitting element, wherein the first terminal of the light emitting element is connected with the second electrode of the driving transistor in the pixel circuit, and a second terminal of the light emitting element is connected with a second power signal terminal.

DETAILED DESCRIPTION

Figure 1:
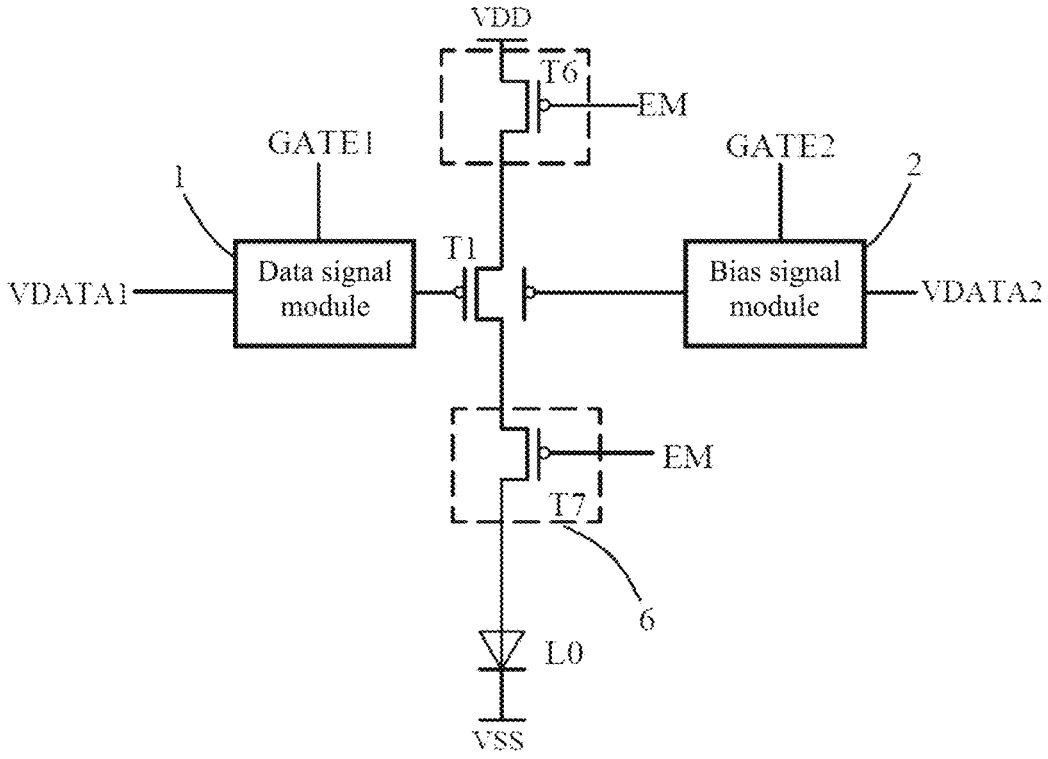
FIG. 1 is a schematic diagram of a pixel circuit according to an embodiment of the present disclosure.

Examples will be described in detail herein, with the illustrations thereof represented in the drawings. When the following descriptions involve the drawings, same numbers in different drawings refer to same or similar elements unless otherwise indicated. The embodiments described in the following examples do not represent all embodiments consistent with the present disclosure. Rather, they are merely examples of apparatuses consistent with some aspects of the present disclosure as detailed in the appended claims.

The terms used herein are only used for the purpose of describing particular examples and not intended to limit the present disclosure. Unless otherwise stated, the technical terms or scientific terms used herein should have general meanings that could be understood by ordinary persons skilled in the art. The words "first", "second" and the like used in the specification and claims of the present disclosure do not represent any order, number or importance, but are merely used to distinguish different components. Likewise, words "one" and "a" and the like also do not represent limitation of number but represent existence of at least one. The word "plurality" or "several" represents two or more. The words "including" or "comprising" and the like are intended to refer to that an element or an article appearing before the "including" or "comprising" covers listed elements or articles and its equivalents appearing after the "including" or "comprising", and does not exclude other elements or articles. The words "connect" or "couple" and the like are not limited to physical or mechanical connection, and may be an electrical connection, whether directly or indirectly. The words "a", "the" and "said" in their singular forms in the present disclosure and the appended claims are also intended to include plurality, unless clearly indicated otherwise in the context. It should also be understood that the term "and/or" as used herein refers to and includes any and all possible combinations of one or more of the associated listed items.

Transistors used in embodiments of the present disclosure include triodes, thin film transistors, or field effect transistors or other devices with same characteristics. To distinguish two electrodes of a transistor other than a control electrode, one electrode of the two electrodes is referred to as a first electrode, and the other electrode is referred to as a second electrode. In actual operation, when the transistor is a thin film transistor or a field effect transistor, the control electrode may be a gate, the first electrode may be a drain electrode, and the second electrode may be a source electrode. Or the control electrode may be a gate, the first electrode may be a source electrode, and the second electrode may be a drain electrode.

The embodiments of the present disclosure provide a pixel circuit. As shown in FIG. 1, the pixel circuit may include a driving transistor T1, a data signal module 1 and a bias signal module 2.

A first electrode of the driving transistor T1 is connected with a first power signal terminal VDD, and a second electrode of the driving transistor T1 is connected with a first terminal of a light emitting element L0. The driving transistor T1 includes a first control electrode and a second control electrode. The data signal module 1 is connected with the driving transistor T1, a data writing signal terminal GATE1, and a data signal terminal VDATA1. The bias signal module 2 is connected with the driving transistor T1, a bias writing signal terminal GATE2, and a bias signal terminal VDATA2, and is configured to adjust a threshold voltage of the driving transistor T1 under control of the bias writing signal terminal GATE2 and the bias signal terminal VDATA2.

In the pixel circuits according to the embodiments of the present disclosure, the bias signal module 2 is connected with the driving transistor T1, the bias writing signal terminal GATE2, and the bias signal terminal VDATA2, and the bias signal module 2 adjusts the threshold voltage of the driving transistor T1 under the control of the bias writing signal terminal GATE2 and the bias signal terminal VDATA2, such that the threshold voltage of the driving transistor T1 can be compensated.

Hereinafter, each part of the pixel circuit in the embodiment of the present disclosure will be described in detail.

Figure 2:
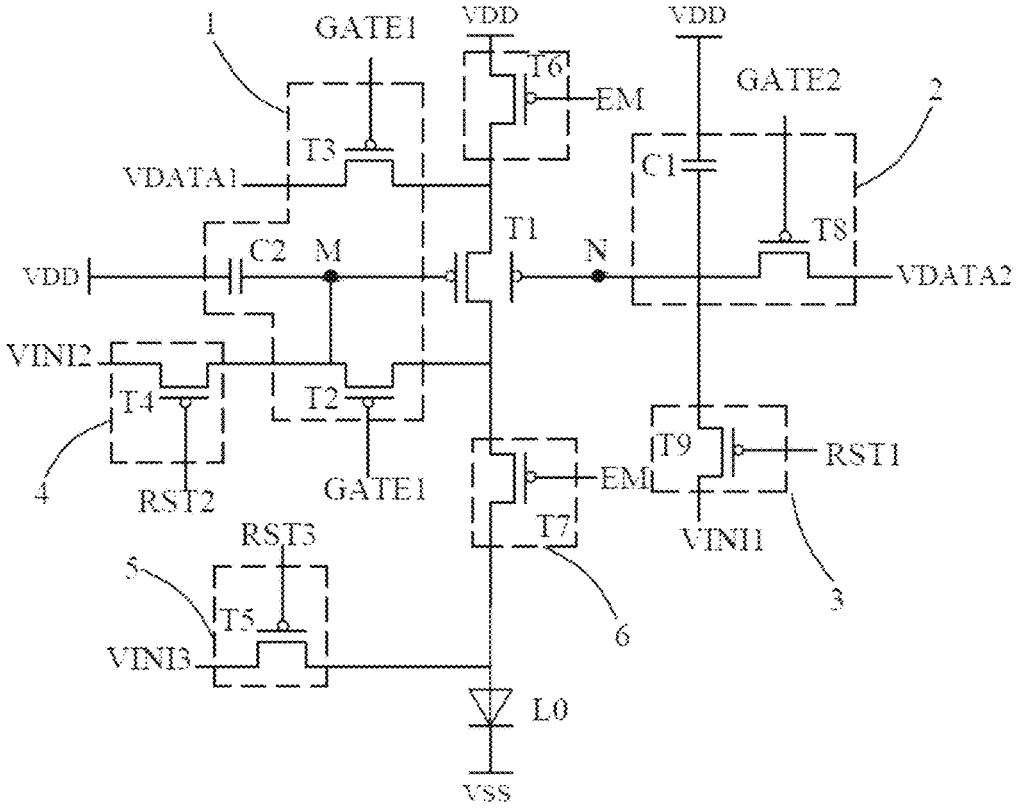
FIG. 2 is a schematic diagram of a pixel circuit according to another embodiment of the present disclosure.

As shown in FIG. 2, the driving transistor T1 includes the first control electrode and the second control electrode. The driving transistor T1 is a double-gate transistor and includes a top gate and a bottom gate. In an example, the first control electrode is an M node in FIG. 2, and a potential of the first control electrode is equal to a potential of the M node. The second control electrode is an N node in FIG. 2, and a potential of the second control electrode is equal to a potential of the N node. One of the first control electrode and the second control electrode is a top gate, and the other is a bottom gate. For example, the first control electrode is a top gate, and the second control electrode is a bottom gate. The first electrode of the driving transistor T1 can be connected with the first power signal terminal VDD. The second electrode of the driving transistor T1 can be connected with the first terminal of the light emitting element L0. A second terminal of the light emitting element L0 can be connected with a second power signal terminal VSS. The light emitting element L0 includes a miniature inorganic light emitting diode, that is, a miniLED or a microLED. Additionally or alternatively, the light emitting element L0 includes an OLED or a QLED. In an example, the first terminal of the light emitting element L0 is a negative electrode, and the second terminal of the light emitting element L0 is a positive electrode. The driving transistor T1 may be a P-type transistor or an N-type transistor.

As shown in FIG. 2, the data signal module 1 is configured to be turned on in response to a data writing signal Gate1, so as to transmit a data signal Vdata1 to the first control electrode of the driving transistor T1, that is, the M node. The data writing signal Gate1 can be provided by the data writing signal terminal GATE1. The data signal Vdata1 can be provided by the data signal terminal VDATA1. In an embodiment of the present disclosure, the data signal module 1 may include a data writing transistor T3 and a compensation transistor T2. A control electrode of the data writing transistor T3 is connected with the data writing signal terminal GATE1 to receive the data writing signal Gate1. A first electrode of the data writing transistor T3 is connected with the data signal terminal VDATA1 to receive the data signal Vdata1. A second electrode of the data writing transistor T3 is connected with the first electrode of the driving transistor T1. The data writing transistor T3 is configured to be turned on in response to the data writing signal Gate1, so as to transmit the data signal Vdata1 to the first electrode of the driving transistor T1. A control electrode of the compensation transistor T2 is connected with the data writing signal terminal GATE1 to receive the data writing signal Gate1. A first electrode of the compensation transistor T2 is connected with the second electrode of the driving transistor T1. A second electrode of the compensation transistor T2 is connected with the first control electrode of the driving transistor T1. The compensation transistor T2 is configured to be turned on in response to the data writing signal Gate1, so as to communicate the second electrode of the driving transistor T1 with the first control electrode of the driving transistor T1. In the present disclosure, a potential of the first control electrode of the driving transistor T1 can be set in advance, such that the driving transistor T1 is also in an on state when the data writing transistor T3 and the compensation transistor T2 are in an on state. Thus, the data signal Vdata1 received by the first electrode of the data writing transistor T3 is sequentially passed through the turned-on driving transistor T1 and compensation transistor T2 and transmitted to the first control electrode of the driving transistor T1.

Figure 8:
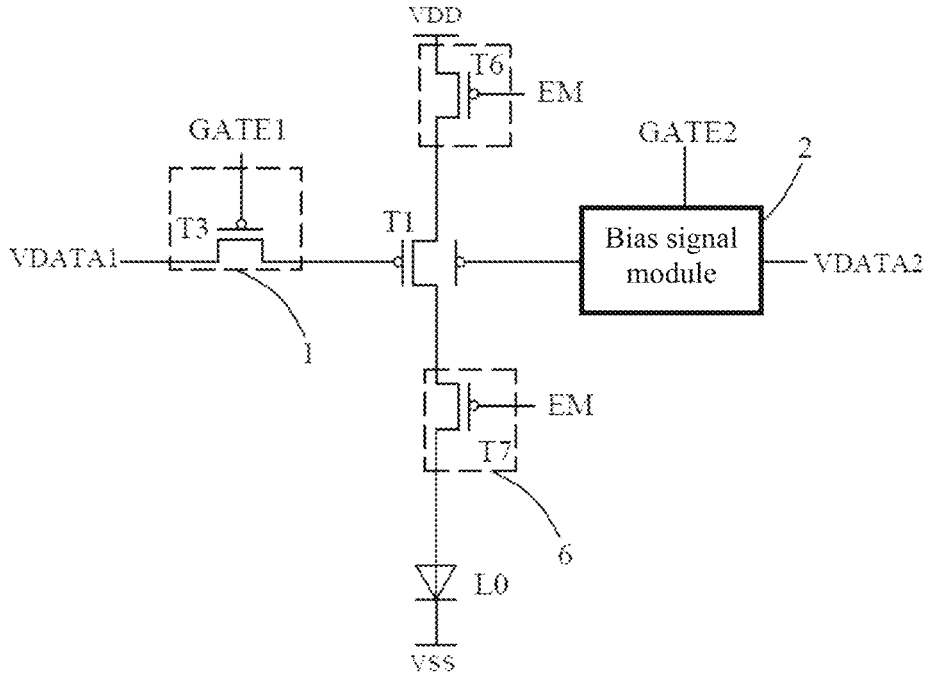
FIG. 8 is a schematic diagram of a pixel circuit according to another embodiment of the present disclosure.

In another embodiment of the present disclosure, as shown in FIG. 8, the data signal module 1 may include a data writing transistor T3. A control electrode of the data writing transistor T3 is connected with the data writing signal terminal GATE1 to receive the data writing signal Gate1. A first electrode of the data writing transistor T3 is connected with the data signal terminal VDATA1 to receive the data signal Vdata1. A second electrode of the data writing transistor T3 is connected with the first control electrode of the driving transistor T1. The data writing transistor T3 is configured to be turned on in response to the data writing signal Gate1, so as to transmit the data signal Vdata1 to the first control electrode of the driving transistor T1.

As shown in FIG. 2, the data signal module 1 may further include a second energy storage element C2. A first terminal of the second energy storage element C2 can be connected with the first power signal terminal VDD, and a second terminal of the second energy storage element C2 can be connected with the first control electrode of the driving transistor T1. The second energy storage element C2 is configured to maintain the potential of the first control electrode of the driving transistor T1. The second energy storage element C2 may be a capacitor.

As shown in FIG. 2, the bias signal module 2 is configured to be turned on in response to a bias writing signal Gate2 to transmit a bias signal Vdata2 to the second control electrode of the driving transistor T1, such that a value of the threshold voltage of the driving transistor T1 increases or decreases. The bias writing signal Gate2 can be provided by the bias writing signal terminal GATE2. The bias signal Vdata2 can be provided by the bias signal terminal VDATA2. The bias signal module 2 may include a bias writing transistor T8. A control electrode of the bias writing transistor T8 is connected with the bias writing signal terminal GATE2 to receive the bias writing signal Gate2. A first electrode of the bias writing transistor T8 is connected with the bias signal terminal VDATA2 to receive the bias signal Vdata2. A second electrode of the bias writing transistor T8 is connected with the second control electrode of the driving transistor T1. The bias writing transistor T8 is configured to be turned on in response to the bias writing signal Gate2, so as to transmit the bias signal Vdata2 to the second control electrode of the driving transistor T1, that is, the N node.

Figure 9:
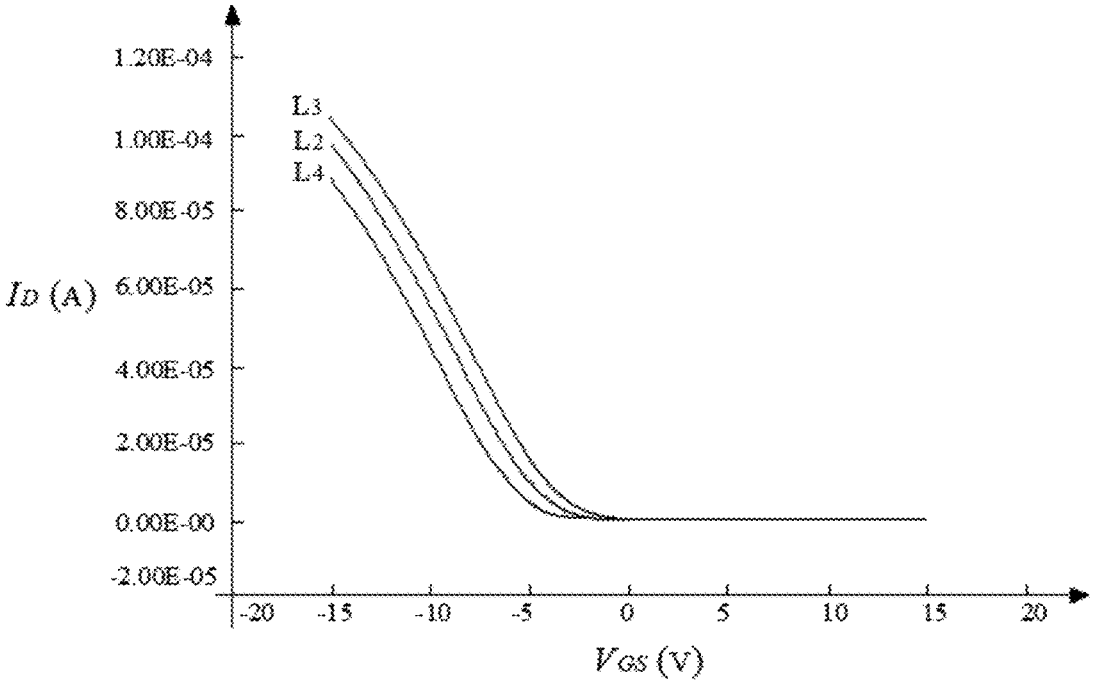
FIG. 9 is a schematic diagram of an increase or decrease in a threshold voltage of a driving transistor in a pixel circuit according to an embodiment of the present disclosure.

As shown in FIG. 2, in an example, after the bias signal Vdata2 is transmitted to the second control electrode of the driving transistor T1, the threshold voltage of the driving transistor T1 can be increased or decreased. In another example, the threshold voltage of the driving transistor T1 can remain unchanged. An increase in the threshold voltage of the driving transistor T1 indicates that a positive bias occurs in the threshold voltage of the driving transistor T1. And a decrease in the threshold voltage of the driving transistor T1 indicates that a negative bias occurs in the threshold voltage of the driving transistor T1. Taking that the driving transistor T1 is a P-type transistor as an example, the threshold voltage of the driving transistor T1 increases when a potential of the bias signal Vdata2 is less than 0, the threshold voltage of the driving transistor T1 decreases when the potential of the bias signal Vdata2 is greater than 0, and the threshold voltage of the driving transistor T1 is unchanged when the potential of the bias signal Vdata2 is equal to 0. Taking that the driving transistor T1 is an N-type transistor as an example, the threshold voltage of the driving transistor T1 decreases when the potential of the bias signal Vdata2 is less than 0, the threshold voltage of the driving transistor T1 increases when the potential of the bias signal Vdata2 is greater than 0, and the threshold voltage of the driving transistor T1 is unchanged when the potential of the bias signal Vdata2 is equal to 0. As shown in FIG. 9, taking that the driving transistor T1 is a P-type transistor as an example, when a potential difference between the second electrode and the first electrode of the driving transistor T1 is 5.1V and the potential of the bias signal Vdata2 is −4V, the threshold voltage of the driving transistor T1 increases, that is, positively biases to the position of a curve $L_3$ from a curve $L_2$. When the potential difference between the second electrode and the first electrode of the driving transistor T1 is 5.1V and the potential of the bias signal Vdata2 is 4V, the threshold voltage of the driving transistor T1 decreases, that is, negatively biases to the position of a curve $L_4$ from the curve $L_2$.

Figure 10:
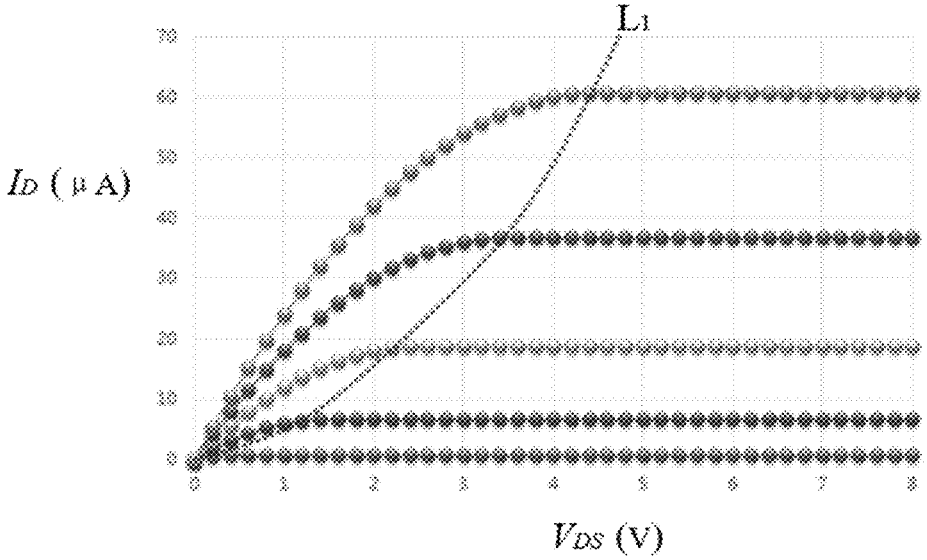
FIG. 10 is a schematic diagram of output characteristic curves of a driving transistor in a pixel circuit according to an embodiment of the present disclosure.

Further, as shown in FIG. 2, after the bias signal Vdata2 is transmitted to the second control electrode of the driving transistor T1, the threshold voltage of the driving transistor T1 can be increased to exceed a potential difference between the first control electrode of the driving transistor T1 and the second electrode of the driving transistor T1. The threshold voltage of the driving transistor T1 can also be decreased to be lower than the potential difference between the first control electrode of the driving transistor T1 and the second electrode of the driving transistor T1. When the driving transistor T1 is a P-type transistor, since the threshold voltage of the driving transistor T1 exceeds the potential difference between the first control electrode of the driving transistor T1 and the second electrode of the driving transistor T1, the driving transistor T1 works in a linear region. When the driving transistor T1 is a P-type transistor, since the threshold voltage of the driving transistor T1 is lower than the potential difference between the first control electrode of the driving transistor T1 and the second electrode of the driving transistor T1, the driving transistor T1 works in a saturation region. When the driving transistor T1 is an N-type transistor, since the threshold voltage of the driving transistor T1 exceeds the potential difference between the first control electrode of the driving transistor T1 and the second electrode of the driving transistor T1, the driving transistor T1 works in the saturation region. When the driving transistor T1 is an N-type transistor, since the threshold voltage of the driving transistor T1 is lower than the potential difference between the first control electrode of the driving transistor T1 and the second electrode of the driving transistor T1, the driving transistor T1 works in the linear region. Therefore, by increasing or decreasing the threshold voltage of the driving transistor T1 through the bias signal Vdata2, a working state of the driving transistor T1 can be switched between the linear region and the saturation region. And when the working state of the driving transistor T1 is switched from the saturation region to the linear region, a target working state can be reached while decreasing a potential value of the first power signal terminal VDD, thereby reducing power consumption. As shown in FIG. 10, the linear region and the saturation region of the driving transistor T1 are divided by a dotted line $L_1$. In FIG. 10, the ordinate $I_D$ represents a current output by the driving transistor T1, and the abscissa $V_{DS}$ represents a potential difference between the second electrode and the first electrode of the driving transistor T1. Each of output characteristic curves corresponds to a different $V_{GS}$, and $V_{GS}$ represents a potential difference between the first control electrode and the first electrode of the driving transistor T1.

As shown in FIG. 2, the bias signal module 2 may further include a first energy storage element C1. A first terminal of the first energy storage element C1 is connected with the first power signal terminal VDD. A second terminal of the first energy storage element C1 is connected with the second control electrode of the driving transistor T1. The first energy storage element C1 is configured to maintain the potential of the second control electrode of the driving transistor T1. The first energy storage element C1 may be a capacitor.

As shown in FIG. 2, in the embodiment of the present disclosure, the pixel circuit may further include a first reset module 3. The first reset module 3 is connected with the second control electrode of the driving transistor T1 and a first reset signal terminal RST1, and is configured to transmit a first initialization signal Vini1 to the second control electrode of the driving transistor T1 under control of the first reset signal terminal RST1. The first reset module 3 is configured to be turned on in response to a first reset signal Rst1 provided by the first reset signal terminal RST1, so as to transmit the first initialization signal Vini1 to the second control electrode of the driving transistor T1. The first initialization signal Vini1 may be provided by a first initialization signal terminal VINI1. The first reset module 3 may include a first reset transistor T9. A control electrode of the first reset transistor T9 is connected with the first reset signal terminal RST1 to receive the first reset signal Rst1. A first electrode of the first reset transistor T9 is connected with the first initialization signal terminal VINI1 to receive the first initialization signal Vini1. A second electrode of the first reset transistor T9 is connected with the second control electrode of the driving transistor T1. The first reset transistor T9 is configured to be turned on in response to the first reset signal Rst1, so as to transmit the first initialization signal Vini1 to the second control electrode of the driving transistor T1.

As shown in FIG. 2, in the embodiment of the present disclosure, the pixel circuit may further include a second reset module 4. The second reset module 4 is connected with the first control electrode of the driving transistor T1 and a second reset signal terminal RST2, and is configured to transmit a second initialization signal Vini2 to the first control electrode of the driving transistor T1 under control of the second reset signal terminal RST2. The second reset module 4 is configured to be turned on in response to a second reset signal Rst2 provided by the second reset signal terminal RST2, so as to transmit the second initialization signal Vini2 to the first control electrode of the driving transistor T1. The second initialization signal Vini2 can be provided by a second initialization signal terminal VINI2. The second reset module 4 may include a second reset transistor T4. A control electrode of the second reset transistor T4 is connected with the second reset signal terminal RST2 to receive the second reset signal Rst2. A first electrode of the second reset transistor T4 is connected with the second initialization signal terminal VINI2 to receive the second initialization signal Vini2. A second electrode of the second reset transistor T4 is connected with the first control electrode of the driving transistor T1. The second reset transistor T4 is configured to be turned on in response to the second reset signal Rst2, so as to transmit the second initialization signal Vini2 to the first control electrode of the driving transistor T1. In an example, the first reset signal terminal RST1 and the second reset signal terminal RST2 can be connected with a same signal line, and the first initialization signal terminal VINI1 and the second initialization signal terminal VINI2 can be connected with a same signal line, thereby reducing the number of wiring of the pixel circuit.

As shown in FIG. 2, in the embodiment of the present disclosure, the pixel circuit may further include a third reset module 5. The third reset module 5 is connected with the first terminal of the light emitting element L0 and a third reset signal terminal RST3, and is configured to transmit a third initialization signal Vini3 to the first terminal of the light emitting element L0 under control of the third reset signal terminal RST3. The third reset module 5 is configured to be turned on in response to a third reset signal Rst3 provided by the third reset signal terminal RST3, so as to transmit the third initialization signal Vini3 to the first terminal of the light emitting element L0. The third initialization signal Vini3 may be provided by a third initialization signal terminal VINI3. The third reset module 5 may include a third reset transistor T5. A control electrode of the third reset transistor T5 is connected with the third reset signal terminal RST3 to receive the third reset signal Rst3. A first electrode of the third reset transistor T5 is connected with the third initialization signal terminal VINI3 to receive the third initialization signal Vini3. A second electrode of the third reset transistor T5 is connected with the first terminal of the light emitting element L0. The third reset transistor T5 is configured to be turned on in response to the third reset signal Rst3, so as to transmit the third initialization signal Vini3 to the first terminal of the light emitting element L0. The first reset signal terminal RST1 and the third reset signal terminal RST3 can be connected with a same signal line, and the first initialization signal terminal VINI1 and the third initialization signal terminal VINI3 can be connected with a same signal line, thereby reducing the number of wiring of the pixel circuit.

As shown in FIG. 2, in the embodiment of the present disclosure, the pixel circuit may further include a light emitting control module 6. The light emitting control module 6 is connected with a light emitting control signal terminal EM, the second electrode of the driving transistor T1 and the first terminal of the light emitting element L0, and is configured to communicate the second electrode of the driving transistor T1 with the first terminal of the light emitting element L0 under control of the light emitting control signal terminal EM. The light emitting control module 6 is configured to be turned on in response to a light emitting control signal em provided by the light emitting control signal terminal EM, so as to communicate the second electrode of the driving transistor T1 with the first terminal of the light emitting element L0. The light emitting control module 6 may include a first light emitting control transistor T7. A control electrode of the first light emitting control transistor T7 is connected with the light emitting control signal terminal EM to receive the light emitting control signal em. A first electrode of the first light emitting control transistor T7 is connected with the second electrode of the driving transistor T1. A second electrode of the first light emitting control transistor T7 is connected with the first terminal of the light emitting element L0. The first light emitting control transistor T7 is configured to be turned on in response to the light emitting control signal em, so as to communicate the second electrode of the driving transistor T1 with the first terminal of the light emitting element L0. The light emitting control module 6 may further include a second light emitting control transistor T6. A control electrode of the second light emitting control transistor T6 is connected with the light emitting control signal terminal EM to receive the light emitting control signal em. A first electrode of the second light emitting control transistor T6 is connected with the first power signal terminal VDD and a second electrode of the second light emitting control transistor T6 is connected with the first electrode of the driving transistor T1. The second light emitting control transistor T6 is configured to be turned on in response to the light emitting control signal em, so as to communicate the first power signal terminal VDD with the first electrode of the driving transistor T1.

A working process of the pixel circuit in FIG. 2 will be described in detail below in conjunction with a working timing chart of the pixel circuit shown in FIG. 3. Taking that all the above transistors are P-type thin film transistors as an example, the on-level of all the transistors is at a low level. The working timing chart illustrates level states of the light emitting control signal em, the first reset signal Rst1, the data writing signal Gate1, and the bias writing signal Gate2 in four stages (a reset stage S1, a data writing stage S2, a bias writing stage S3 and a light emitting stage S4 of the pixel circuit) and potential states of the data signal Vdata1 and the bias signal Vdata2. The first reset signal terminal RST1, the second reset signal terminal RST2, and the third reset signal terminal RST3 can be connected with a same signal line, that is, the second reset signal Rst2 and the third reset signal Rst3 are the same as the first reset signal Rst1. The first initialization signal terminal VINI1, the second initialization signal terminal VINI2, and the third initialization signal terminal VINI3 are also connected with a same signal line, that is, the third initialization signal Vini3 and the second initialization signal Vini2 are the same as the first initialization signal Vini1. The pixel circuits of the present disclosure can be used for a display apparatus. The display apparatus may include pixel units distributed in an array, and each of the pixel units is provided with a corresponding pixel circuit. Pixel circuits provided in pixel units in a same row can share the light emitting control signal em, the first reset signal Rst1, the data writing signal Gate1 and the bias writing signal Gate2. Pixel circuits provided in pixel units in a same column can share the data signal Vdata1 and the bias signal Vdata2. Pixel circuits provided in all pixel units can share the first initialization signal Vini1.

Figure 3:
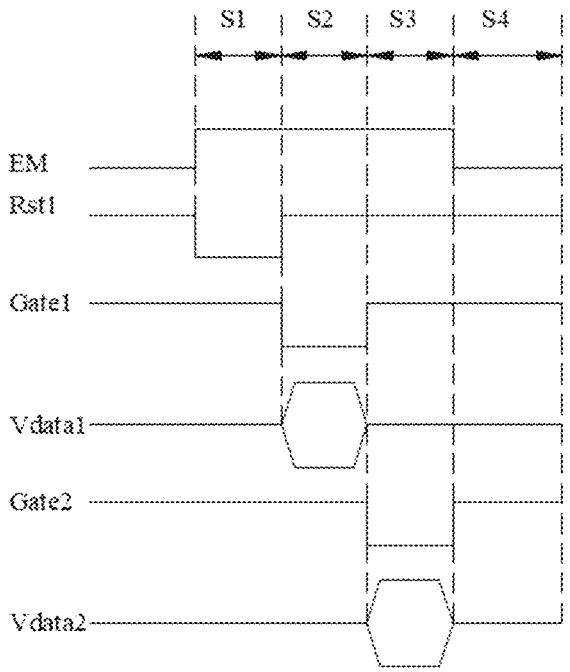
FIG. 3 is a working timing chart of the pixel circuit shown in FIG. 2.
Figure 4:
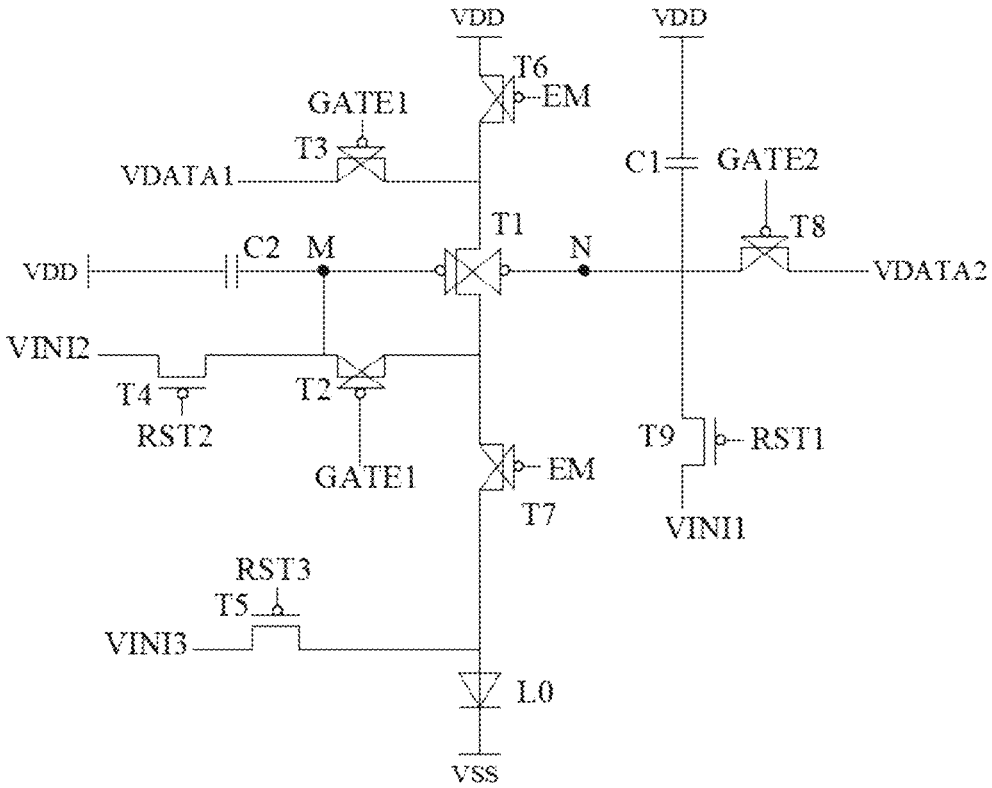
FIGS. 4-7 schematically illustrate equivalent circuit diagrams of a pixel circuit at different stages according to embodiments of the present disclosure.

As shown in FIGS. 3 and 4, in the reset stage S1 of the pixel circuit, the first reset signal Rst1 is at a low level, the first reset transistor T9, the second reset transistor T4 and the third reset transistor T5 are turned on. The first initialization signal Vini1 is transmitted to the first control electrode of the driving transistor T1, the second control electrode of the driving transistor T1, and the first terminal of the light emitting element L0. The potentials of the first control electrode and the second control electrode of the driving transistor T1 are both equal to a potential value of the first initialization signal Vini1.

Figure 5:
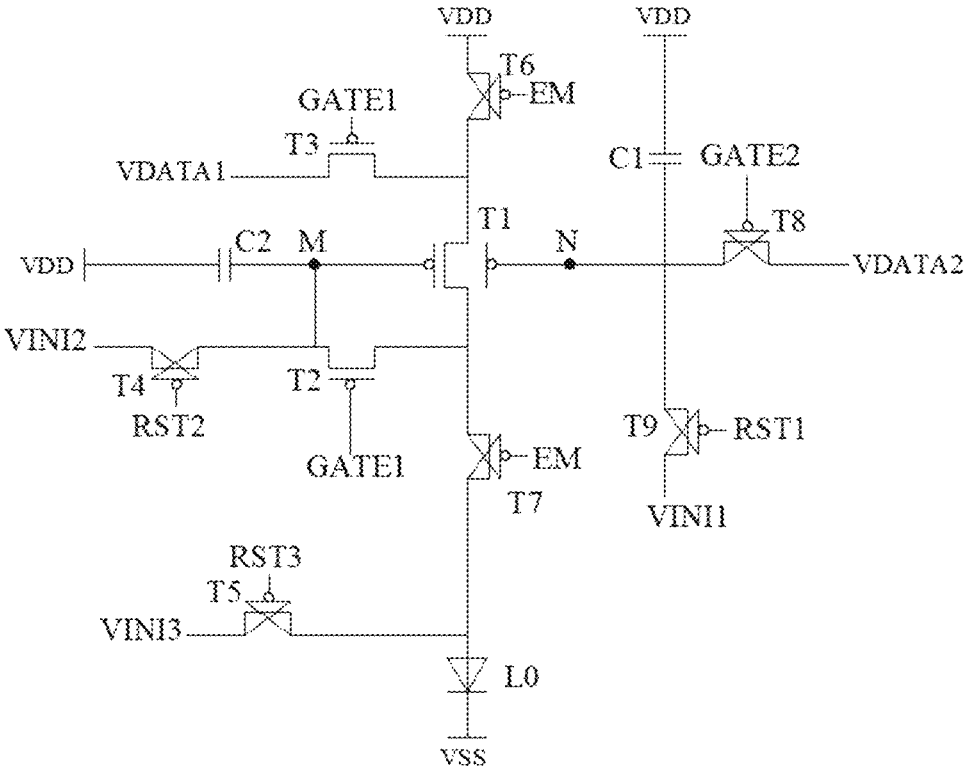

As shown in FIG. 3 and FIG. 5, in the data writing stage S2 of the pixel circuit, the data writing signal Gate1 is at a low level, and the data writing transistor T3 and the compensation transistor T2 are turned on. By pre-setting the potential value of the first initialization signal Vini1, a difference between a potential of the first control electrode of the driving transistor T1 and a potential of the first electrode of the driving transistor T1 can be smaller than the threshold voltage Vth of the driving transistor T1, such that the driving transistor T1 is also in an on state. Therefore, the potential of the first control electrode of the driving transistor T1 can be charged through the data signal Vdata1, and when the potential of the first control electrode of the driving transistor T1 becomes (Vdata1+Vth), the driving transistor T1 becomes a cut-off state. The potential of the second control electrode of the driving transistor T1 is equal to the potential value of the first initialization signal Vini1.

Figure 6:
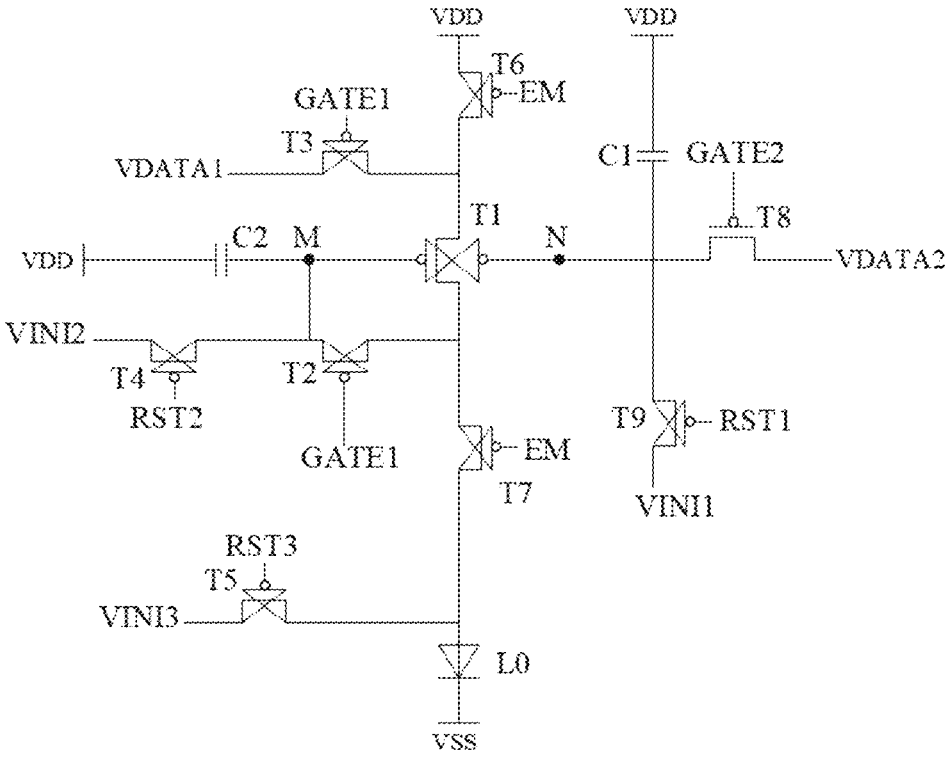

As shown in FIG. 3 and FIG. 6, in the bias writing stage S3 of the pixel circuit, the bias writing signal Gate2 is at a low level, and the bias writing transistor T8 is turned on, so that the bias signal Vdata2 is written into the second control electrode of the driving transistor T1. By controlling a potential value of the bias signal Vdata2, the working state of the driving transistor T1 can be in the linear region or the saturation region. The potential of the first control electrode of the driving transistor T1 is (Vdata1+Vth), and the potential of the second control electrode of the driving transistor T1 is the potential value of the bias signal Vdata2.

Figure 7:
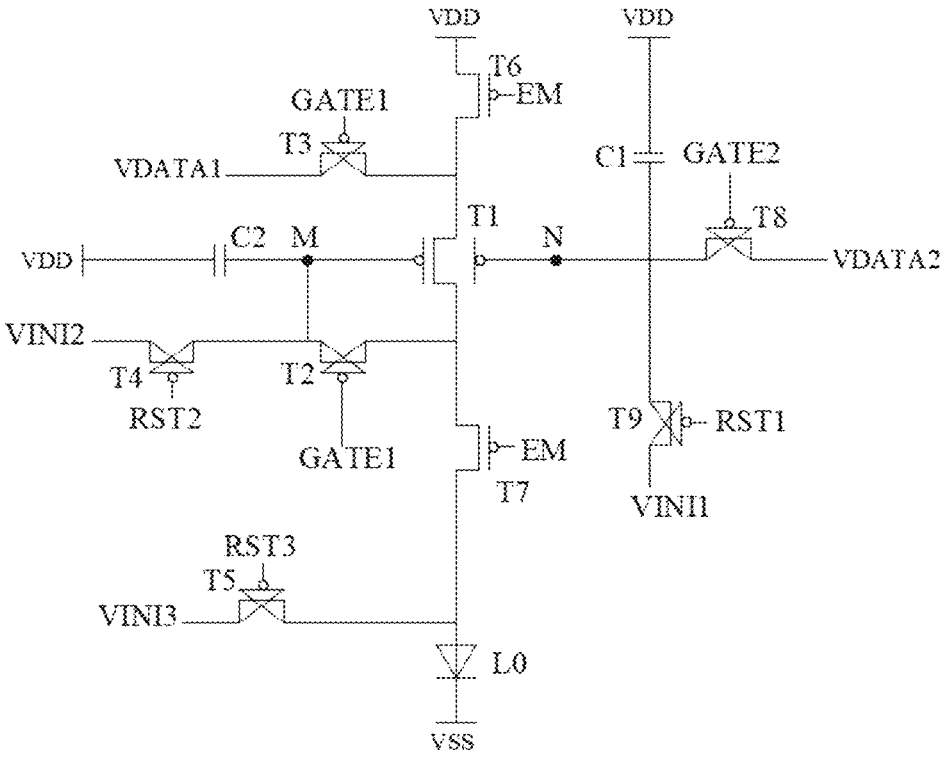

As shown in FIGS. 3 and 7, in the light emitting stage S4 of the pixel circuit, the first light emitting control transistor T7 and the second light emitting control transistor T6 are both turned on. The first power signal terminal VDD is electrically connected with the first electrode of the driving transistor T1. The second electrode of the driving transistor T1 is electrically connected with the first terminal of the light emitting element L0. A formula for calculating an current $I_D$ output by the driving transistor T1 is:

$$I_D = \mu C_{ox}\frac{W}{L}\left[(V_{GS} - Vth)V_{DS} - \frac{1}{2}V_{DS}^2\right]$$

where, μ is an electron mobility, Cox is a gate oxide layer capacitance, $V_{GS}$ is a potential difference between the first control electrode and the first electrode of the driving transistor T1, $$\frac{W}{L}$$

is a width-to-length ratio of a channel region of the driving transistor T1, and $V_{DS}$ is a potential difference between the second electrode and the first electrode of the driving transistor T1.

If the threshold voltage Vth of the driving transistor T1 is decreased with the influence of the bias signal Vdata2 and is lower than the potential difference between the first control electrode of the driving transistor T1 and the second electrode of the driving transistor T1, the driving transistor T1 works in the saturation region, and a working current generated by the driving transistor T1 and applied to the light emitting element L0 is:

$$I_D = \frac{1}{2}\mu C_{ox}\frac{W}{L}(V_{GS} - Vth)^2 = \frac{1}{2}\mu C_{ox}\frac{W}{L}(Vdata + Vth - VDD - Vth)^2 = \frac{1}{2}\mu C_{ox}\frac{W}{L}(Vdata - VDD)^2$$

It can be seen that a value of the working current is independent of the threshold voltage Vth of the driving transistor T1, thereby eliminating the influence of the threshold voltage on the working current and achieving pixel compensation. The potential of the first control electrode of the driving transistor T1 is (Vdata1+Vth), and the potential of the second control electrode of the driving transistor T1 is the potential value of the bias signal Vdata2.

The embodiments of the present disclosure also provide a method of driving a pixel circuit, which is used to drive the pixel circuits described in the above embodiments. The method of driving a pixel circuit may include: as shown in FIG. 1, the data signal module 1 receives the data writing signal Gate1 provided by the data writing signal terminal GATE1, and transmits the data signal Vdata1 provided by the data signal terminal VDATA1 to the driving transistor T1 and the bias signal module 2 adjusts the threshold voltage of the driving transistor T1 under the control of the bias writing signal terminal GATE2 and the bias signal terminal VDATA2. Since the pixel circuits driven by the driving methods in the embodiments of the present disclosure are the same as the pixel circuits in the above-mentioned embodiments, they have the same beneficial effects, which will not be repeated here.

As shown in FIG. 2, after the bias signal Vdata2 is transmitted to the second control electrode of the driving transistor T1, the threshold voltage of the driving transistor T1 can be increased to exceed the potential difference between the first control electrode of the driving transistor T1 and the second electrode of the driving transistor T1. The threshold voltage of the driving transistor T1 can also be decreased to be lower than the potential difference between the first control electrode of the driving transistor T1 and the second electrode of the driving transistor T1.

The embodiments of the present disclosure also provide a display apparatus. As shown in FIG. 1, the display apparatus may include a plurality of light emitting elements L0 and respective pixel circuits described in any one of the above embodiments. A first terminal of the light emitting element L0 is connected with the second electrode of the driving transistor T1 in the pixel circuit, and a second terminal of the light emitting element L0 is connected with the second power signal terminal VSS. The display apparatus can be any product or component with a display function, such as a mobile phone, a tablet computer, a television, a notebook computer, a digital photo frame, a navigator, etc. Since the pixel circuits in the display apparatus of the embodiments of the present disclosure are the same as the pixel circuits in the above-mentioned embodiments, they have the same beneficial effects, which will not be repeated here.

For the display apparatuses, pixel circuits, and methods of driving a pixel circuit of the present disclosure, the bias signal module is connected with the driving transistor, the bias writing signal terminal and the bias signal terminal, and the bias signal module adjusts the threshold voltage of the driving transistor under the control of the bias writing signal terminal and the bias signal terminal, such that the threshold voltage of the driving transistor can be compensated.

The foregoing descriptions are merely preferred embodiments of the present disclosure, and are not intended to limit the present disclosure in any form. Although the present disclosure is disclosed in the preferred embodiments as above, these preferred embodiments are not intended to limit the present disclosure. Any person skilled in the art may change or modify the technical contents disclosed above into equivalent embodiments with equivalent changes without departing from the scope of the technical solutions of the present disclosure. Any simple changes, or modifications or equivalent changes made to the above embodiments by those skilled in the art according to the technical substance of the present disclosure without departing from the technical solutions of the present disclosure, will still belong to the scope of the technical solutions of the present disclosure.

What is claimed is:

1. A pixel circuit, comprising:

a driving transistor, wherein a first electrode of the driving transistor is connected with a first power signal terminal, a second electrode of the driving transistor is connected with a first terminal of a light emitting element, and the driving transistor comprises a first control electrode and a second control electrode;

a data signal module, connected with the driving transistor, a data writing signal terminal and a data signal terminal;

a bias signal module, connected with the driving transistor, a bias writing signal terminal and a bias signal terminal, and configured to adjust a threshold voltage of the driving transistor under control of the bias writing signal terminal and the bias signal terminal;

a first reset module, connected with the second control electrode of the driving transistor and a first reset signal terminal, and configured to transmit a first initialization signal to the second control electrode of the driving transistor under control of the first reset signal terminal.

2. The pixel circuit of claim 1, wherein the bias signal module comprises:

a bias writing transistor, wherein a control electrode of the bias writing transistor is connected with the bias writing signal terminal, a first electrode of the bias writing transistor is connected with the bias signal terminal, and a second electrode of the bias writing transistor is connected with the second control electrode of the driving transistor.

3. The pixel circuit of claim 2, wherein the bias signal module further comprises:

a first energy storage element, wherein a first terminal of the first energy storage element is connected with the first power signal terminal, and a second terminal of the first energy storage element is connected with the second control electrode of the driving transistor.

4. The pixel circuit of claim 2, wherein the driving transistor is a P-type transistor, the threshold voltage of the driving transistor increases when a potential of a bias signal provided by the bias signal terminal is less than 0, and the threshold voltage of the driving transistor decreases when the potential of the bias signal is greater than 0.

5. The pixel circuit of claim 2, wherein the driving transistor is an N-type transistor, the threshold voltage of the driving transistor decreases when a potential of a bias signal provided by the bias signal terminal is less than 0, and the threshold voltage of the driving transistor increases when the potential of the bias signal is greater than 0.

6. The pixel circuit of claim 1, wherein the first reset module comprises:

a first reset transistor, wherein a control electrode of the first reset transistor is connected with the first reset signal terminal, a first electrode of the first reset transistor is connected with a first initialization signal terminal, and a second electrode of the first reset transistor is connected with the second control electrode of the driving transistor.

7. The pixel circuit of claim 1, wherein the data signal module comprises:

a data writing transistor, wherein a control electrode of the data writing transistor is connected with the data writing signal terminal, a first electrode of the data writing transistor is connected with the data signal terminal, and a second electrode of the data writing transistor is connected with the first electrode of the driving transistor;

a compensation transistor, wherein a control electrode of the compensation transistor is connected with the data writing signal terminal, a first electrode of the compensation transistor is connected with the second electrode of the driving transistor, and a second electrode of the compensation transistor is connected with the first control electrode of the driving transistor; and a second energy storage element, wherein a first terminal of the second energy storage element is connected with the first power signal terminal, and a second terminal of the second energy storage element is connected with the first control electrode of the driving transistor.

8. The pixel circuit of claim 7, further comprising:

a second reset module, connected with the first control electrode of the driving transistor and a second reset signal terminal, and configured to transmit a second initialization signal to the first control electrode of the driving transistor under control of the second reset signal terminal.

9. The pixel circuit of claim 8, wherein the second reset module comprises:

a second reset transistor, wherein a control electrode of the second reset transistor is connected with the second reset signal terminal, a first electrode of the second reset transistor is connected with a second initialization signal terminal, and a second electrode of the second reset transistor is connected with the first control electrode of the driving transistor.

10. The pixel circuit of claim 8, further comprising:

a third reset module, connected with the first terminal of the light emitting element and a third reset signal terminal, and configured to transmit a third initialization signal to the first terminal of the light emitting element under control of the third reset signal terminal.

11. The pixel circuit of claim 10, further comprising:

a light emitting control module, connected with a light emitting control signal terminal, the second electrode of the driving transistor and the first terminal of the light emitting element, and configured to electrically connect the second electrode of the driving transistor with the first terminal of the light emitting element under control of the light emitting control signal terminal.

12. The pixel circuit of claim 1, further comprising:

a light emitting control module, connected with a light emitting control signal terminal, the second electrode of the driving transistor and the first terminal of the light emitting element, and configured to electrically connect the second electrode of the driving transistor with the first terminal of the light emitting element under control of the light emitting control signal terminal.

13. The pixel circuit of claim 12, wherein the light emitting control module comprises:

a first light emitting control transistor, wherein a control electrode of the first light emitting control transistor is connected with the light emitting control signal terminal, a first electrode of the first light emitting control transistor is connected with the second electrode of the driving transistor, and a second electrode of the first light emitting control transistor is connected with the first terminal of the light emitting element.

14. The pixel circuit of claim 13, wherein the light emitting control module further comprises:

a second light emitting control transistor, wherein a control electrode of the second light emitting control transistor is connected with the light emitting control signal terminal, a first electrode of the second light emitting control transistor is connected with the first power signal terminal, and a second electrode of the second light emitting control transistor is connected with the first electrode of the driving transistor.

15. A method of driving a pixel circuit, applied to driving the pixel circuit of claim 1, the method comprising:

receiving, by the data signal module, a data writing signal provided by the data writing signal terminal, transmitting, by the data signal module, a data signal provided by the data signal terminal to the driving transistor;

adjusting, by the bias signal module, the threshold voltage of the driving transistor under control of the bias writing signal terminal and the bias signal terminal; and transmitting, by the first reset module, a first initialization signal to the second control electrode of the driving transistor under control of the first reset signal terminal.

16. The method of claim 15, wherein a bias signal provided by the bias signal terminal causes a value of the threshold voltage of the driving transistor to exceed or be lower than a potential difference between the first control electrode of the driving transistor and the second electrode of the driving transistor.

17. A display apparatus, comprising:

a pixel circuit, comprising:

a driving transistor, wherein a first electrode of the driving transistor is connected with a first power signal terminal, a second electrode of the driving transistor is connected with a first terminal of a light emitting element, and the driving transistor comprises a first control electrode and a second control electrode;

a data signal module, connected with the driving transistor, a data writing signal terminal and a data signal terminal;

a bias signal module, connected with the driving transistor, a bias writing signal terminal and a bias signal terminal, and configured to adjust a threshold voltage of the driving transistor under control of the bias writing signal terminal and the bias signal terminal;

a first reset module, connected with the second control electrode of the driving transistor and a first reset signal terminal, and configured to transmit a first initialization signal to the second control electrode of the driving transistor under control of the first reset signal terminal; and the light emitting element, wherein the first terminal of the light emitting element is connected with the second electrode of the driving transistor in the pixel circuit, and a second terminal of the light emitting element is connected with a second power signal terminal.

* * * * *